United States Patent [19]

Gutzwiller

[11] 4,295,789

[45] Oct. 20, 1981

[54] COVER PLATES FOR TANK HEADS

[75] Inventor: Howard L. Gutzwiller, Zelienople, Pa.

[73] Assignee: Robinson Industries, Inc., Zelienople, Pa.

[21] Appl. No.: 65,122

[22] Filed: Aug. 9, 1979

[51] Int. Cl.[3] ..... F04D 29/18; F04D 29/32

[52] U.S. Cl. ..... 416/213 A; 29/159.3; 29/156.8

[58] Field of Search ..... 29/159.3, 156.8 R; 415/212 R; 416/213 A

[56] References Cited

U.S. PATENT DOCUMENTS 2,649,243 8/1953 Stacker ..... 29/156.8 R 3,991,703 11/1976 Faust ..... 29/156.8 R 4,040,769 8/1977 Britz ..... 416/213 A

*Primary Examiner*—William L. Freeh

[57] ABSTRACT

The axial flow fan includes a hub, an annular rim, at least one structural disc welded to and extending between the hub and the rim and a plurality of blades extending outward from the rim. The improvement comprises at least one nonstructural cover plate which is welded to and extends between the hub and the peripheral edge of the rim. Generally there will be a nonstructural cover plate at each end of the hub and rim with the cover plates being of thinner cross section than the structural disc. The cover plates are normally welded along the terminal edge surfaces of the rim as well as the hub.

4 Claims, 2 Drawing Figures

COVER PLATES FOR TANK HEADS

FIELD OF THE INVENTION

My invention relates to axial flow fans and, more particularly, to nonstructural cover plates used on the tank head of axial flow fans used in high temperature corrosive environments.

DESCRIPTION OF THE PRIOR ART

Axial flow fans used in high temperature corrosive atmospheres such as heat treating furnaces employed in the metals or chemical industries are operated under severe operating conditions. The fans are exposed to substantial centrifugal force loading and must withstand the tendency to flex under operating conditions. Because of the centrifugal force the material strength of the fabricated fan assembly must provide a sufficient safety factor over the resultant stresses. It has also been recognized that most heat treating furnaces provide a corrosive environment which attacks weld areas before the structural members themselves and, therefore, substantial weld area is provided to minimize any weld decay.

Weld decay of structural members requires the removal of the fan and shipment back to the manufacturer for extensive replacement of effected parts.

Several designs have been employed to reinforce and strengthen the tank head assemblies. One such design involves the utilization of a central disc with stiffener plates extending between the hub, disc and rim and which extend subjacent to the blades and midway of the blades which are actually disposed about the rim. While such a design provides additional weld area, because of the normal vertical placement of such a fan in a furnace, pockets are formed adjacent the central disc which collect corrosive solids and which ultimately attack the welds.

In my copending application Ser. No. 26,036, filed Apr. 4, 1979, I disclosed an improved axial flow fan in which pairs of reinforcement plates or stiffeners are associated with each blade. While such a design greatly decreases the tendency of the tank head rim to flex under operating conditions, it still results in pockets formed adjacent the central disc where corrosive solids may build up and attack the welds.

For many years fan tank heads have been designed with three parallel and spaced discs used to support the rim about the hub and reinforce the blades under operating conditions. However, each of the discs is a structural member necessary to support the rim and withstand the centrifugal force loading. This has created problems because only the first assembled disc is welded along both sides since the remaining structural discs are inexcessible along at least one side when assembled to the hub within the rim. In addition, pockets are formed which collect corrosive solids. Certain three disc designs extend the outer discs beyond the rim so as to provide structural support for the blades as well as the rim. While this may eliminate certain of the pockets, weld decay still requires sending the entire unit back to the factory for repair since field repair is not satisfactory for structural members.

SUMMARY OF THE INVENTION

My invention provides an improved tank head design whereby critical weld areas are protected from decay to nonstructural cover plates. In addition, because of the nonstructural nature of the cover plates, field repairs can be easily made since none of these structural members are effected. The weld contact area of the structural members is completely protected and any decay which takes place is done sacrifically to the nonstructural members.

My improved tank head design includes a hub, an annular rim, at least one structural disc welded to and extended between the hub and the rim and a plurality of blades extending outward from the rim. The improvement comprises nonstructural cover plates, generally at each end of the hub, welded to and extending between the hub and the peripheral edge of the rim. The nonstructural cover plates are generally thinner in cross section than the structural disc, and vent holes are provided in the structural disc and the downstream cover plate.

DESCRIPTION OF THE PREFERRED EMBODIMENTS

The axial flow fan, generally designated 10, is normally utilized in applications such as high temperature heat treating furnaces and the like. The fan often forms part of a unit which can be installed directly into a furnace wall or cover plate. Certain applications require that the air movement within the chamber be reversed from time to time to maintain a more even heat distribution and, therefore, certain applications require reversing fans. It is not uncommon for applications which require fan speeds of 700 to 1200 rpm's and temperatures up to 1800° F. Typical applications are carbon rod baking furnaces for electrodes, annealing furnaces and homogenizing furnaces for various metal products.

Figure 1:
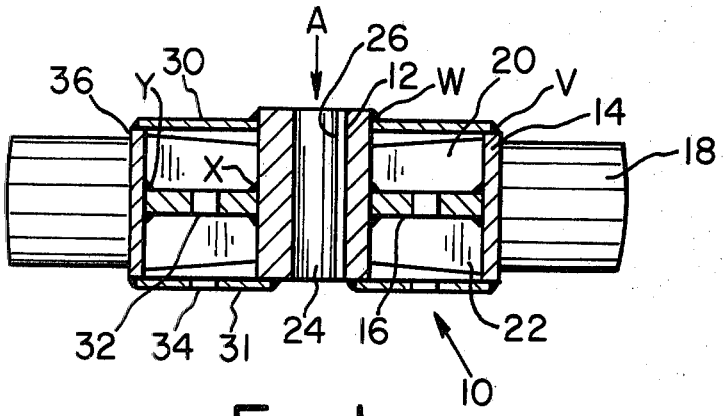
FIG. 1 is a section taken midway through my improved axial flow fan.

The typical axial flow fan 10 is fabricated from several main components, namely, the hub 12, the rim 14, the disc 16 and the plurality of blades 18, FIG. 1. The hub 12, rim 14 and disc 16 are often referred to as the tank head with the blades 18 being attached by welding to the outer band or tank head rim 14.

Specifically, the hub 12 includes a central coaxial bore 24 having a keyway 26 so as to accommodate the drive shaft (not shown) from an appropriate power source. The tank head rim 14 is annular and is positioned coaxially and concentrically about the hub 12 and spaced therefrom. The hub 12 is secured to the rim 14 by means of a central structural disc 16 extending normal to the axis of the hub 12 from a point substantially midway of the hub 12. The disc 16 is welded along both of its faces adjacent its edge contact with the hub 12 and the rim 14, such welds being shown as X and Y, respectively, FIG. 1.

Figure 2:
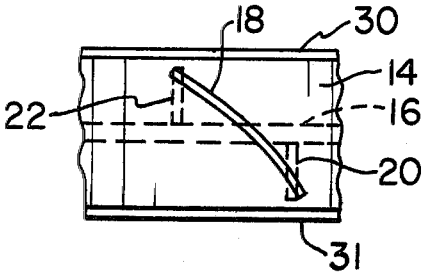
FIG. 2 is a plan view of a single blade showing the location of two reinforcement plates, the central disc and the nonstructural cover plates.

A pair of reinforcement plates or stiffeners 20 and 22 are associated with each blade 18, FIGS. 1 and 2. The plates 20 and 22 extend along the disc 16 on opposite sides thereof from the hub 12 to the rim 14. For each pair of reinforcement plates, one of the plates 20 is positioned just rearward of the leading edge of the blade 18 and the other plate 22 is positioned just forward of the trailing edge of the blade 18, FIG. 2. Full welds are provided on both sides of each plate adjacent the edge contacts with the hub 12, rim 14 and disc 16. The plates 20 and 22 act as structural reinforcement to prevent flexure of the tank head.

A pair of nonstructural cover plates 30 and 31, respectively, are positioned at opposing ends of the hub 12. The cover plates 30 are generally thinner in cross section than the structural central disc 16. Cover plate 30, which is basically annular and extends about the hub 12, extends radially outward to a point midway of the edge surface 36 of the rim 14. Full welds W are provided about the hub 12 joining the hub to the cover plate 30. Full welds V are also provided joining the cover plate to the rim edge 36. Welds V are located along the edge surface 36 of the rim 14.

The second cover plate 31 likewise extends from the midpoint of the edge surface of rim 14 to the hub 12 and is welded thereto in the same manner as plate 30.

With the fan 10 installed in a vertical position and the general flow of air being in the direction of arrow A, vent holes 34 are provided in the downstream cover plate 31 and vent holes 32 are provided in the central disc 16 to permit equalization of pressure. The cover plate 30 is positioned at the top of the fan in the installed position. As such, vent holes are not provided in cover plate 30 since this would permit the collection of corrosive solids in the space formed between the cover plate 30 and the central disc 16.

In order to determine if nonstructural cover plates could be employed in such high temperature environments, a test installation was developed using a 27 inch diameter tankhead assembly having a single central structural disc and twelve stiffeners associated therewith as in FIGS. 1 and 2. The central structural disc was one-half inch and constructed of stainless steel. The cover plates installed as shown in FIG. 1 were three-sixteenths inch stainless steel. The cover plates were welded along the outer edge surface of the tank head rim and to the hub. The tankhead was installed on a large laboratory furnace and while the tankhead was run at 735 rpm's, the furnace temperature was rapidly increased to 1600° F., held for approximately three hours, and then quickly cooled. This cycle was repeated ten times. After each cycle, measurements were taken at twelve locations along the downstream cover disc to determine the amount of distortion caused by the rapid change in temperature. There was no significant amount of warpage or distortion of the cover plate after ten cycles up to 1600° F. In addition, there was no cracking due to material movement or distortion in the static portion of the fan assembly.

Any weld decay that occurs will be sacrifically taken by the cover plates. Repairs can be made in the field since structural members are not involved.

I claim:

1. An axial flow fan comprising:

A. a hub having a central axis;

B. an annular rim concentrically positioned and spaced from the hub;

C. a disc extending normal to the central axis substantially midway of the hub and connecting the hub to the rim said disc being a structural member providing the primary structural support for the rim;

D. a plurality of blades, each blade extending outward from the rim and angularly disposed thereto to form a leading and trailing edge;

E. first and second reinforcement plates extending radially outward in opposite directions and spaced from and along the central axis, said plates welded to the hub, disc and rim, said first plate extending subjacent the leading edge of each blade and said second plate extending subjacent the trailing edge; and F. a pair of nonstructural disc-shaped cover plates, each plate welded to the hub and to a terminal edge of the annular rim, wherein said nonstructural cover plates protect structural members, is sacrificial in relation thereto and is accessible and refurbishable in the field.

2. The improvement of claim 1, said structural disc and said downstream cover plate including vent holes therethrough.

3. The axial flow fan of claim 1, said cover plates being thinner in cross section than said disc.

4. The axial flow fan of claim 3, said disc having a cross section of one-half inch and said cover plates having a cross section of three-sixteenths inch.

* * * * *